United States Patent [19]

Burnham

[11] Patent Number: 4,724,556

[45] Date of Patent: Feb. 16, 1988

[54] LATCH FOR CRIB DROPSIDE

[75] Inventor: Benjamin K. Burnham, Merrimack, N.H.

[73] Assignee: Gem Industries, Inc., Gardner, Mass.

[21] Appl. No.: 917,847

[22] Filed: Oct. 14, 1986

[51] Int. Cl.[4] ..... A47D 7/02

[52] U.S. Cl. ..... 5/100; 5/93 R

[58] Field of Search ..... 5/93 R, 100, 424, 425, 5/200 R, 201, 203, 207, 208

[56] References Cited

U.S. PATENT DOCUMENTS

| | | | |
|---|---|---|---|
| 1,179,684 | 4/1916 | Vallone | 5/100 |
| 2,383,167 | 8/1945 | Shaw | 5/100 |
| 2,429,421 | 10/1947 | Merrett et al. | 5/11 |
| 2,473,914 | 6/1949 | Shaw | 5/100 |
| 2,630,582 | 3/1953 | Bukolt | 5/93 R X |
| 2,845,634 | 8/1958 | Landry | 5/100 X |
| 3,002,199 | 10/1961 | Galloway | 5/100 |
| 3,649,973 | 3/1972 | Benoit et al. | 5/93 R X |
| 3,896,514 | 7/1975 | Feldstein | 5/11 X |
| 4,413,365 | 11/1983 | Flye et al. | 5/100 |
| 4,535,493 | 8/1985 | Guillot | 5/100 |

FOREIGN PATENT DOCUMENTS

| | | | |
|---|---|---|---|
| 107184 | 4/1939 | Australia | 5/100 |

*Primary Examiner*—Alexander Grosz
*Assistant Examiner*—Carl M. DeFranco, Jr.
*Attorney, Agent, or Firm*—Charles R. Fay

[57] ABSTRACT

A childs' crib having a drop side, with a latch therefor requiring a double motion, up and inwardly toward the center of the crib, to release it for gravity drop of the drop side from its uppermost, latched position.

4 Claims, 6 Drawing Figures

FIG. 2
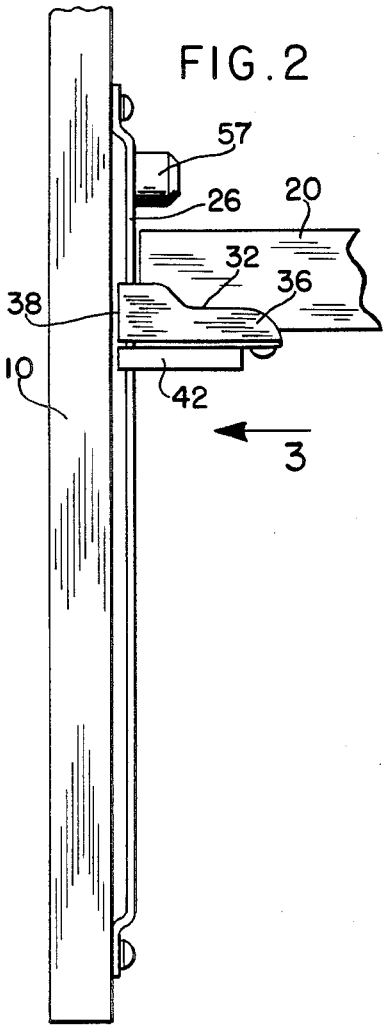
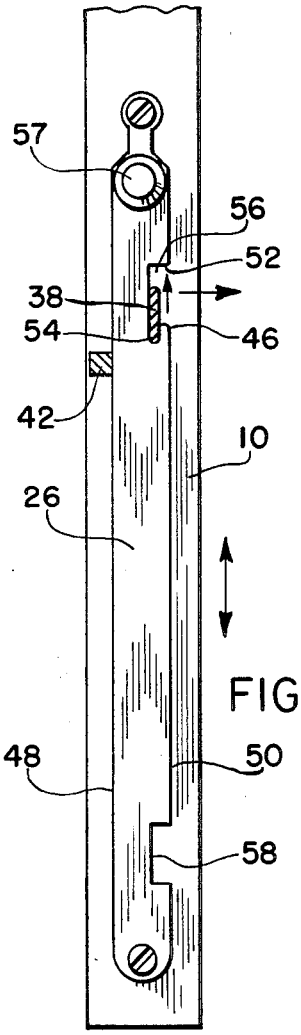
FIG. 3
FIG. 4
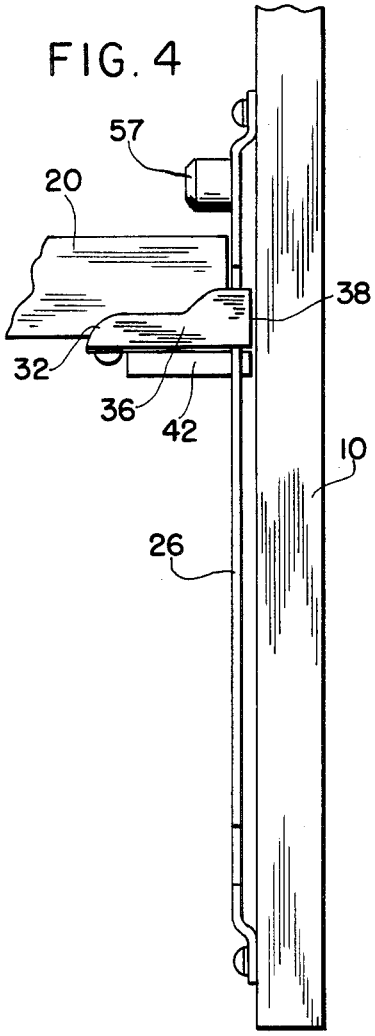
FIG. 5
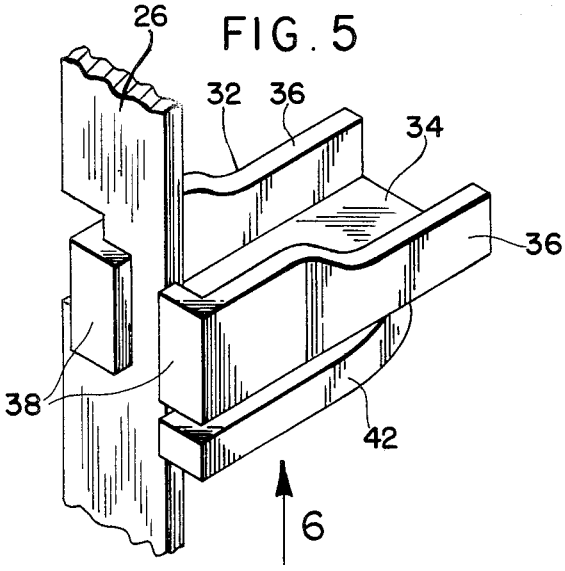
FIG. 6
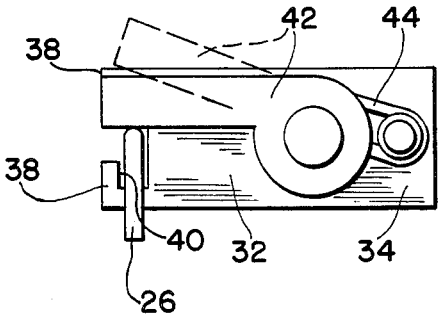

LATCH FOR CRIB DROPSIDE

FIELD OF THE INVENTION

Latch structure for holding the drop side of a childs' crib safely and firmly in raised position, and which is only capable of dropping through the use of a double motion, one of which requires at least a 10 pound pressure.

BACKGROUND OF THE INVENTION

Drop side of infants' cribs have certain requirements for safety including latches that will not allow the crib side to drop except under a double motion, like lift and push, wherein one of the motions requires a pressure of ten pounds to actuate. The pressure is preferably on the push motion: that is, with the drop side in locked, up position, the actuation is to raise the drop side a small amount and then push it horizontally and inwardly against pressure, to release the latch so the crib side can drop by gravity.

The usual latch requires manual lifting and knee or hand operation to release it, and it is the purpose of this invention to provide a more simple, inexpensive construction that is capable of foot actuation, to leave the hands free.

SUMMARY OF THE DISCLOSURE

Instead of the usual droprods, the present drop side slides vertically on a pair of end-aligned flat elongated guide plates on each front side corner post. There is a guide for the top rail of the drop side on each corner post and a guide for the bottom rail of the drop side on each corner post. The guide plates face each other, and latch constructions are located on the ends of the bottom rail and have operative engagement with corresponding pair of guide rails for the bottom rail. The top rail merely has sliding engagement at all time with its corresponding guide plate. When the drop side is raised, it automatically latches, and when it is desired to lower the drop side, it must be slightly raised and then pushed inwardly against a 10 pound spring, one in each latch, i.e. one at end of the lower rail of the drop side. The top rail and its guides form no part of this invention except in so far as it is guided in its vertical motion in concert with the lower or bottom rail.

With the latches associated with the bottom rail only, the latch construction is such that the operator may slightly raise the drop side with his foot and push the bottom rail inwardly, also with his foot or ankle, and then raise the drop side with the foot, thereby freely the hands. The top rail can be raised the slight amount necessary by hand, and then the foot used to push the bottom rail in, and hand and foot can be used to raise the drop side.

The structure of the latch, there being one at each end of the bottom rail, resides in a spring biassed means to cause a member on the bottom rail to snap into an offset notch in an edge of the corresponding guide plate, when the drop side is elevated. Thus, the drop side being freely manually raised, has means thereon to latch it automatically and when freed of the lifting hand or foot, drops into a part of the offset notch which prevents disengagement of the latch without an initial slight lift of the entire drop side. The same biassing spring can be utilized to latch the dro side down also, but in this case there is no double action required to free the drop side from the corresponding guide.

BRIEF DESCRIPTION OF THE DRAWINGS

FIG. 2 is a view on an enlarged scale showing the latch from the front aspect of the crib;

FIG. 3 is a view in elevation looking in the direction of arrow 3 in FIG. 2, parts being broken away;

FIG. 4 is a rear-elevational view of FIG. 2;

FIG. 5 is a perspective view of a latch and its guide plate; and

FIG. 6 is a bottom view of the latch, looking in the direction of arrow 6 in FIG. 5.

PREFERRED EMBODIMENT OF THE INVENTION

Figure 1:
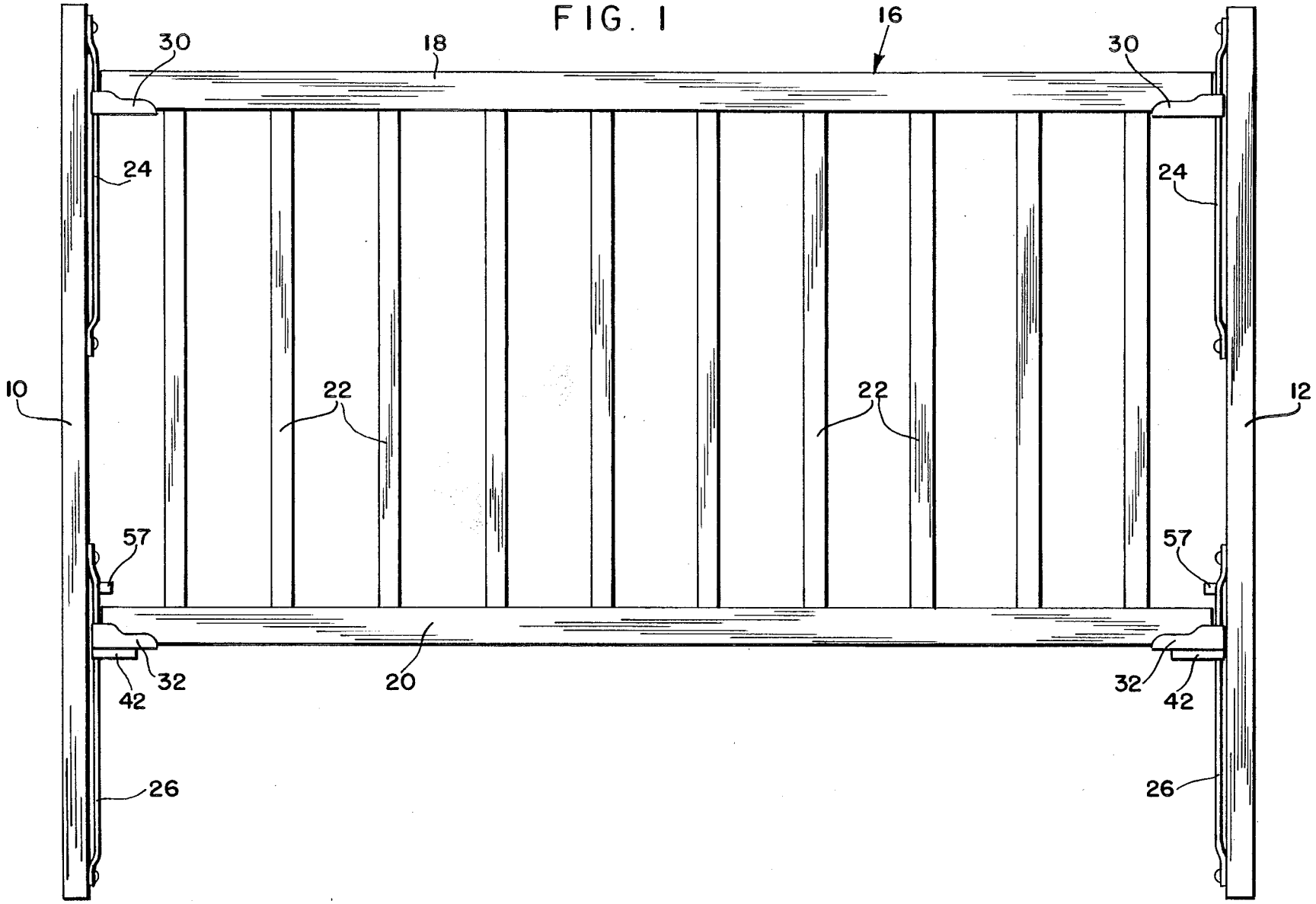
FIG. 1 is a front elevational view of a crib embodying the new latch construction.

Conventional crib construction is well known and only so much of a crib is shown as to clearly describe the invention. The crib has two front corner posts 10 and 12 and it has mattress support, end walls, rear wall, etc., all as usual and not here shown. A drop side is indicated generally at 16 and it has top rail 18, bottom rail 20, and connecting stiles 22. In FIG. 1, the drop side is indicated in up position in solid lines and at least inpart, in down position by dotted lines.

Each corner post has mounted thereon a pair of spaced, end aligned, narrow, elongated guide plates 24, upper, and 26 lower. These plates face each other in pairs and the lower plates 26 are latching plates as well as guide plates, whereas the upper plates 24,24 are merely guide plates. Suitable guide brackets 30 of any convenient design are mounted at the ends of upper rail 18 and slidingly engage the guide plates 24 for controlled up and down motion of the drop sides.

A guide bracket 32 is applied to the lower or bottom rail 20 at each end thereof. A bracket 32 is shown in FIGS. 5 and 6 and has a closed bottom 34, side walls 36, inwardly directed front ears 38, and a fully open top and end opposite the ears. The end of the rail 20 is located in this "box" with a space between the extreme end of the rail and the inside aspect of the ears to a slot 40, FIG. 6, to accommodate the guide plate 26 in a slidable manner. Thus the drop side is slidable on plates 26 as it slides on plates 24.

On the bottom surface of the bottom 34 there is a spring biassed member 42 is herein shown as pivoted to the bottom 32 and pressed by a spring 44 to bear with 10 pounds pressure on an edge of guide plate 26. This spring may be of any suitable description and the same is true of the member 42, but the manner shown herein is a practical one. The member 42 bears at all times on the edge of the plate 26, pressing bracket 32 and therefore the lower rail 20 forwardly and the inner or left hand ear 38 in FIG. 5 against the inner edge of the guide plate 26.

The inner edge of guide plate 26 has an offset or bayonet type slot near its upper end. This slot is shown at 46 in FIG. 3, the outer edge of the guide plate 26 being indicated at 48 and the inner edge, relative to the crib, at 50. The slot 46 is in edge 50 and comprises an entrance 52 for ears 38, and a pocket 54, for the latching action. The pocket 54 has a height greater than the height of the material of bracket 32, see 56 in FIG. 3, so that the drop side is latched by gravity and even when the drop side is pulled up, to allow the bracket to escape through the entrance 52, the force of the spring 44 opposes this action, and has to be overcome to let the drop side become free, and drop by gravity. When the drop side is raised to a point where the bracket 20 aligns with the entrance 52, the spring pushes the rail 20 and its bracket to locking position, and released, the drop side of course drops into a latched condition.

The numeral 57 indicates a stop at the top of guide plate 26 that prevents disassembly of the drop side when pulled up too energetically.

A notch 58 in the same edge of the guide plate 26 as the slot at 52, can receive a part of the bracket 32, under the pressure of spring pressed element 42, to temporarily latch the drop side in its down position. It is easy to press on rail 20 i.e. to the left in FIG. 3, to release the drop side and allow it to be moved upwards.

I claim:

1. A crib comprising rectangularly spaced corner posts, a drop side panel between the corner posts, drop side guides mounted vertically on the corner posts, means on the drop side panel engaging the guides for guiding up and down movement of the drop side panel between the corner posts, said drop side panel having upper and lower operative positions, a latch to hold the drop side panel in its upper operative position, said latch being releasable to allow the drop side panel to drop by gravity only upon the combination of a first vertical motion and a second horizontal motion applied to the drop side panel, said drop side panel having an upper rail and a lower rail, said guide engaging means on the drop side panel comprising a bracket at each end of each rail, said brackets being slidably engaged with the guides, the latch being associated with said bracket on said lower rail, each bracket being box-like and having a rectangular bottom, a pair of opposite longitudinal side walls extending upwardly from said bottom and extending in a cantilevered manner beyond said bottom at one end thereof, an open top, an open end opposite said one end of said bottom, and said one end being an at least partially closed end, each end of said side rails being held in one of said brackets with each end extending through said open end and resting on said bottom between said longitudinal side walls, said at least partially closed end being formed by ears extending inwardly from said opposite side walls, said ears being spaced outwardly from said bottom at said one end thereof thereby providing an opening between said bottom and said ears through which one of said drop side guides is slidably received, said guides being flat, vertically elongated and located at facing aspects of said corner posts, so that the guides are parallel to said posts and extend inwardly and outwardly and have outer and inner edges, a slot in the inner edge of at least one guide, said slot extending from the inner edge towards the outer edge of the respective guide, then extends down forming a bayonet type slot, each guide being slidably received in the opening of respective brackets engaging the guide between the ears and bottom of said bracket with the inner and outer edges of the guide being located respectively adjacent opposite of said bracket side walls, said latch being a portion of the side wall of at least one bracket on the lower rail abutting adjacent the inner edge of said slot of at least one guide having said slot, a resilient element on said bracket on said lower rail engaging at least one guide having said slot, said resilient element pressing resiliently on the outer edge of the respective guide to normally urge said lower rail outwardly toward said outer edge of said guide said sidewall of said bracket being biased adjacent said inner edge of said guide and entering the slot when aligned therewith and entering the portion of the slot that extends downwardly under the action of gravity, whereby the dropside panel as a whole must be raised to free the bracket from the downward extending portion of the slot and the lower rail must then be pushed toward the center of the crib against the action of said resilient means, to free the bracket from the slot and allow the drop side panel to drop, and said resilient element comprising a spring biased lever pivotally mounted on and beneath the bottom of said at least one bracket for swinging motion in a plane parallel to said bottom.

2. The crib of claim 1 including a slot on the rearward edge of the slotted guide, said second-named slot being located below the first-named slot, the bracket having the resilient element tending to engage the second-named slot when the drop side is down.

3. The crib of claim 2 wherein the second-named slot is a simple slot and only a rearward push on the lower rail is sufficient to dislodge it.

4. The crib of claim 2 wherein the degree of force needed to dislodge the bracket from the bayonet slot approximates 10 pounds.

* * * * *